United States Patent [19]

Wilkinson

[11] Patent Number: 4,544,281

[45] Date of Patent: Oct. 1, 1985

[54] MIXERS

[75] Inventor: Noel R. Wilkinson, Burton-on-Trent, England

[73] Assignee: Robert Morton DG Limited, England

[21] Appl. No.: 630,976

[22] Filed: Jul. 16, 1984

[30] Foreign Application Priority Data

Jul. 21, 1983 [GB] United Kingdom ..... 8319719

[51] Int. Cl.[4] ..... B01F 7/20

[52] U.S. Cl. ..... 366/325; 366/343; 416/210 R

[58] Field of Search ..... 99/277.2; 366/279, 288, 366/289, 302, 306, 307, 325, 327, 330, 331, 342, 343; 416/194 R, 210 R, 223 R, 235, 237, DIG. 3

[56] References Cited

U.S. PATENT DOCUMENTS

| | | | |
|---|---|---|---|
| 1,271,581 | 7/1918 | Keith | 366/279 |
| 1,522,060 | 1/1925 | Jacoby | 366/342 |
| 2,082,796 | 6/1937 | Gaertner | 366/307 |
| 2,530,858 | 11/1950 | Cerniak | 416/235 |

*Primary Examiner*—Robert W. Jenkins
*Assistant Examiner*—Arthur D. Dahlberg
*Attorney, Agent, or Firm*—Wood, Herron & Evans

[57] ABSTRACT

A fluid mixer in which a pair of interconnected blades (6,6') are mounted either side of a rotatable shaft (8), the blades are each formed from a flat plate bent to form two or more planar portions (40, 42, 44) and mounted to the shaft so that the leading edge (52, 54, 56) of each portion is at a lesser radial distance than the trailing edge (54, 56, 58) of each portion. In this way each blade portion is angled inwardly accurately and the whole blade is easy to form.

12 Claims, 7 Drawing Figures

MIXERS

The present invention relates to fluid mixers suitable for use in a brewing process.

Mash mixers and cereal cookers generally comprise a cylindrical vessel the axis of which is vertical having a dome shaped bottom; the sides and normally the bottom are heated by means of a jacket, double wall or ducting into which steam is introduced to raise the temperature of the fluid contents of the vessel; a paddle or mixing blade is arranged to rotate in the vessel to ensure even heating of the contents. Such vessels have been made in a wide range of sizes from as little as 1 meter in diameter to 7 meters or more in diameter. Cereal cookers are generally smaller than mash mixers but of similar proportions.

The term "fluid mixer" is used hereinafter to include mash mixers and cereal cookers and is not restricted to those uses only. For instance the present invention may be suitable for use for other purposes such as mixing blood plasma and is particularly suitable for fluids which are shear sensitive and in which negatively buoyant matter is included in the fluid to be mixed.

Whilst mash mixers normally have their mixing blades driven from above, the invention is not restricted to over driven mixing.

The considerations when constructing a fluid mixer of the type described are well known and are broadly that the movement across the heated areas of the vessel must ensure good overall heat transfer without burning, that the mixing process should not damage by shear force the particles within the fluid and that excessive energy is not required for mixing.

It is an object of the present invention to provide an improved fluid mixer for the kind described.

A fluid mixer according to the invention comprises a vessel having mixing means rotatable in the vessel, the mixing means comprising at least a pair of interconnected blades, each blade being mounted respectively on either side of a rotation axis, each blade being formed from two or more interconnected substantially planar portions, the leading edge of each portion being at a lesser radial distance than the trailing edge of each portion.

The formation of the blades from planar portions enables the blade configuration to be accurately and economically formed.

Preferably, there are two blades and each blade portion is arranged so that the leading portion is at a first angle or rake to the vertical, the second and subsequent portions (when present), being at respectively increasing rake angles away from the vertical and towards the centre of the vessel from the leading to the trailing portion. In such an arrangement the axis of rotation of the mixing means is vertical but in other arrangements the axis may itself be angled to the vertical in which case the angles or rakes are relative the axis of rotation. The vessel is preferably cylindrical with its axis vertical. The bottom of the vessel may be dome shaped.

Preferably there are three or more planar blade portions and in a preferred embodiment there are three planar blade portions and an additional sweep portion formed or attached to the leading planar portion and directed from the leading edge of the leading portion towards the axis of rotation. In the preferred embodiment the angles of rake of the portions are 0 degrees for the leading portion, 10 degrees inwardly for the next and second portion and 15 degrees inwardly for the trailing portion, the three planar portions being formed on a single plate. In this embodiment the leading portion is angled at about 30° inwardly in the direction of rotation from the tangent drawn on the circle of rotation of the leading edge so as to give a slip angle of 60° at the leading edge; the trailing edge of each blade, that is of the trailing portion is also angled at about 30° inwardly in the direction of rotation from the tangent drawn on the circle of rotation of the trailing edge so as to give a slip angle of 60° at the trailing edge. Preferably the circle of rotation of the leading edge is about 42⅓% of the diameter of the vessel and the mean circle of rotation of the trailing edge is about 85% of the diameter of the vessel. The bottom of the axis of mixing means is preferably 5% off centre from the cylindrical axis of the vessel. The lower edge of the blades should be about 50 mm clear from the vessel bottom, and the blade height about 10% of the vessel diameter. In use the vessel should be arranged to be filled to a height of 0.6 to 0.7 times the vessel diameter. Drive means connected to the mixing means should be such as to drive the mixing means at a tip speed of 0.750 to 850 ft/min (230 to 260 m/min). This speed is suitable for obtaining a good mixing action or agitation without the shear forces being too high. For a mixer of the preferred design with a 4250 mm diameter vessel a tip speed of 850 ft/min (260 m/min) would therefore be achieved at a rotation speed of 22¾ rpm.

A fluid mixer according to two preferred embodiments of the invention will now be described by way of example with reference to the drawings in which.

Figure 1:
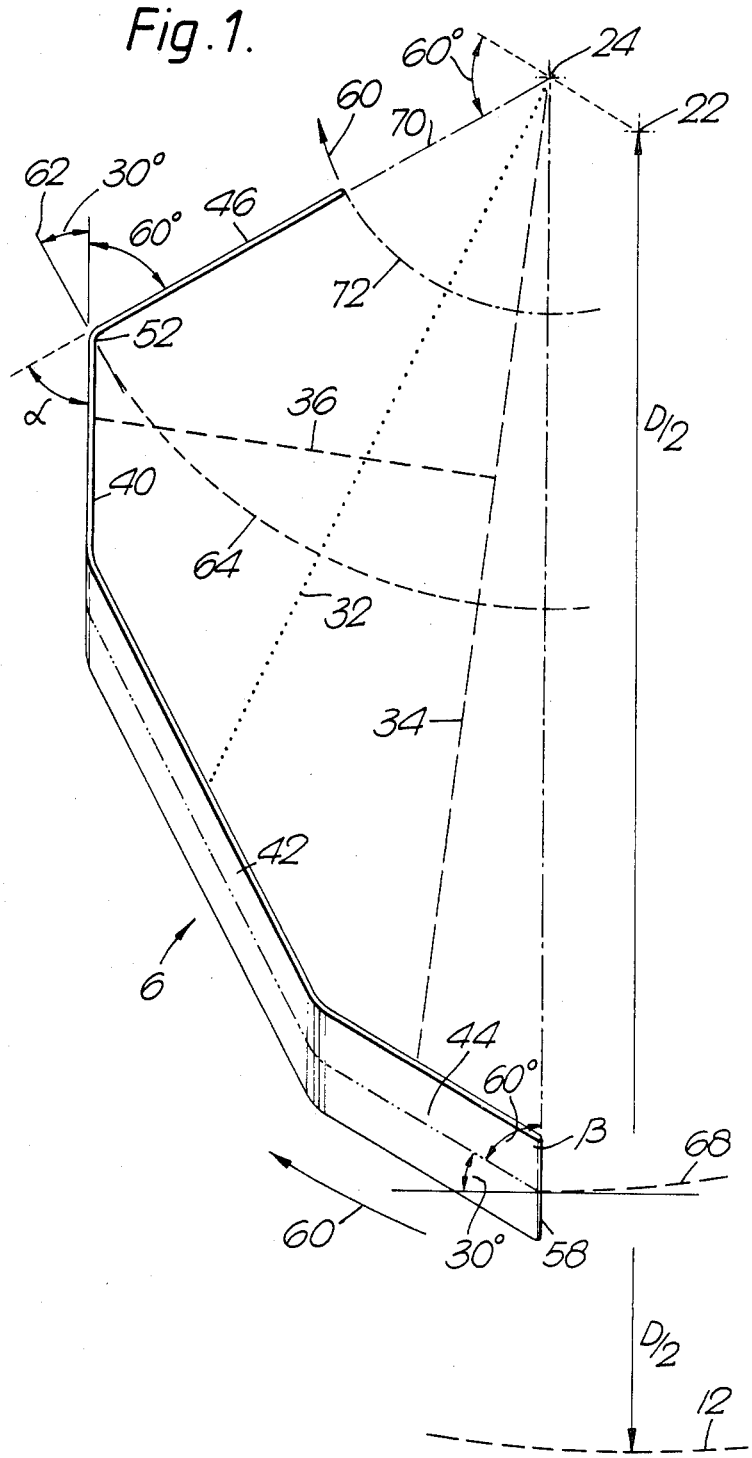
FIG. 1 is a plan view of the one of the mixer blades.
Figure 3:
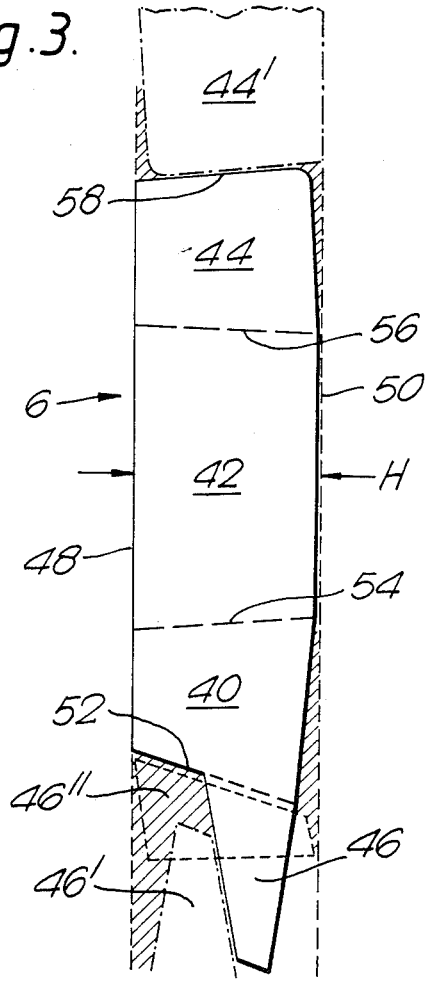
Figure 4:
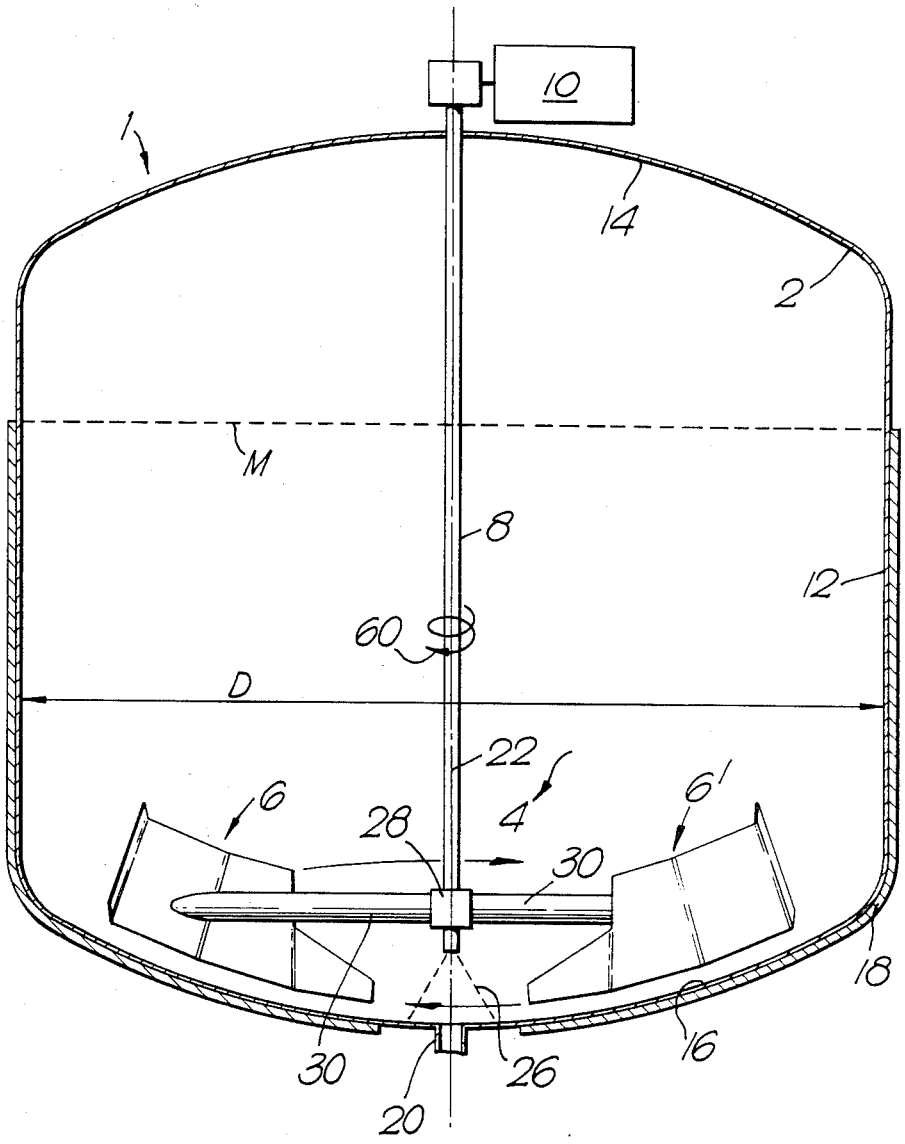
Figure 6:
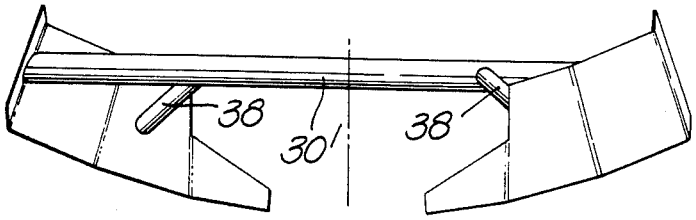
Figure 7:
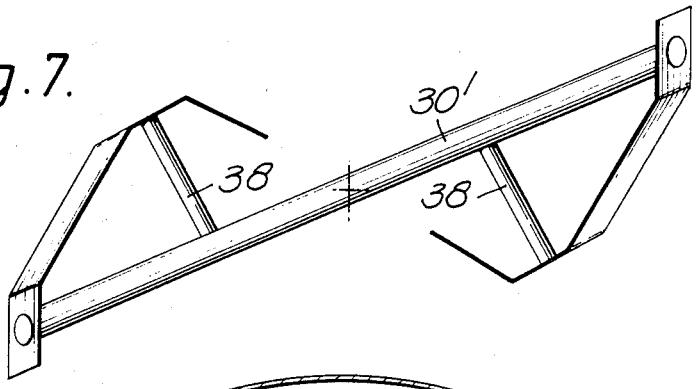
Figure 5:
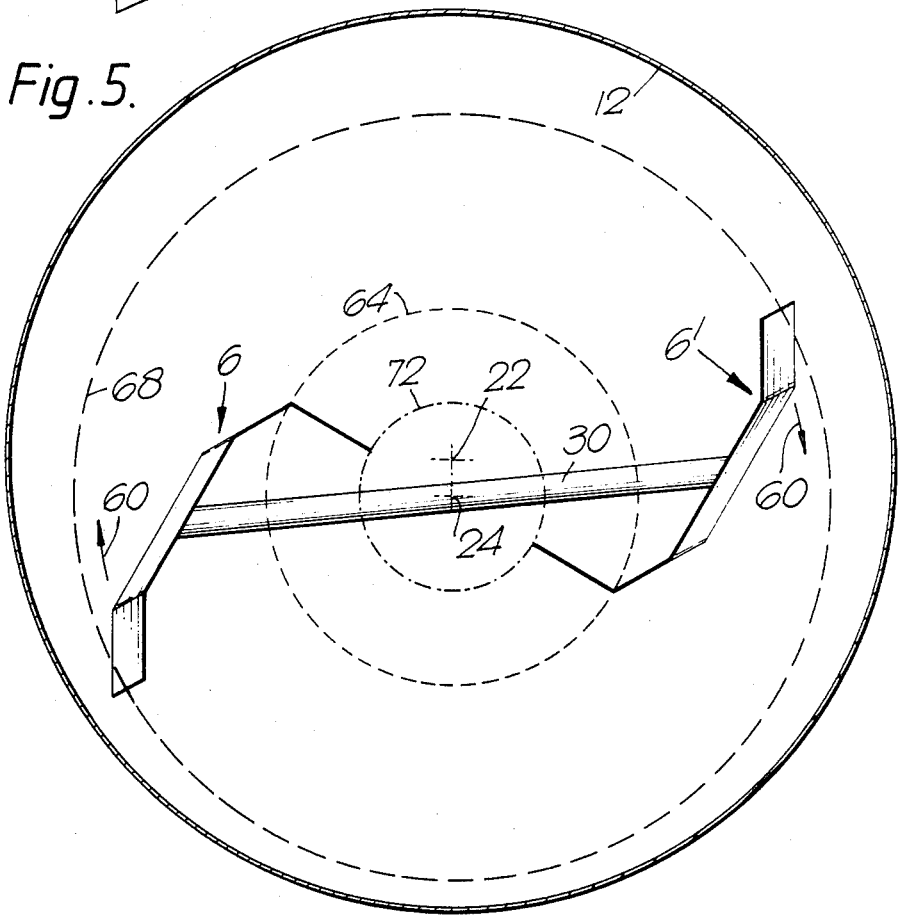

FIG. 3 is a plan view of the blade of FIG. 1 in the completely planar form before bending to the shape of FIG. 1, FIG. 4 is an elevation of a pair of the blades of FIG. 1 mounted with a vessel, FIG. 5 is a plan view of FIG. 4 showing an off central mounting, FIG. 6 is an elevation of a pair of the blades of FIG. 1 but with a modified connecting strut, and FIG. 7 is a plan view of the blade of FIG. 6.

In FIG. 1 can be seen a fluid mixer 1 suitable for mash mixing or cereal cooking comprising a vessel 2 and a mixing means 4 comprising a pair of rotatable blades 6, 6' driven by a shaft 8 connected to a motor 10.

The vessel 2 has a cylindrical wall 12 and a domed top 14 and domed bottom 16 with an outer steam heated jacket 18. The vessel has an inlet or inlets (not shown) and an outlet 20 which is diagrammatically shown at the bottom. The inlet(s) and outlet maybe in any suitable position. The vessel has a vertical axis 22 which in the drawing appears to be coaxial with the axis of drive shaft 8 but which is normally offset by about 4 to 6% and preferably 5% of the diameter D of the vessel as is shown in FIG. 5 where the shaft axis is shown at 24. The shaft axis 24 is normally parallel to the vessel axis 22 but may be slightly angled to the vessel axis. In the shown embodiment the drive shaft is driven from above and is supported by a bracket 26 shown diagrammatically attached to the bottom 16. The shaft may however extend through the bottom and be driven from below.

The blades 6, 6' are supported on shaft 8 on a hub 28 by means of an interconnecting support means comprising a pair of arms or yoke 30. The yoke may extend between mid portions of the blades along line 32 (FIG. 1) and as shown in FIGS. 4 and 5 or else a yoke 30' may extend between trailing portions of the blades along line 34 (FIG. 1) with supplemental struts 38 extending along line 36 (FIG. 1) from yoke 30' to leading portions of the blades as seen in FIGS. 6 and 7. Equally the strut and yoke arrangement of FIGS. 6 and 7 can be replaced by a single plate attached to all three portions of one blade 6 and extending across the hub 28 to a similar attachment on the opposite blade 6'.

The blades 6 and 6' are mounted to the drive shaft so that they are about 50 mm clear from the bottom 16 and generally have a height H (see FIG. 3) defined as the mean height across a central portion where H is 7 to 15% x the vessel diameter (d) and preferably 10%D.

Figure 2:
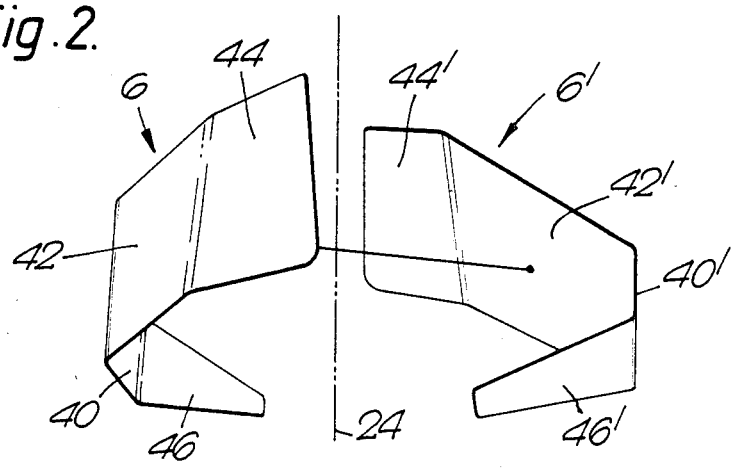
FIG. 2 is a perspective elevation of a pair of the blades of FIG. 1.

The blade form will now be described in detail with particular reference to FIGS. 1, 2 and 3.

Each blade 6, 6' is formed from a flat plate of stainless steel having preferably three main portions comprising a leading portion 40, an intermediate portion 42 and a trailing portion with an optional but preferred sweep portion extending from the leading portion 40. The main portions uper edges prior to bending the flat plate forms a straight line 48. The lower edges are confined by line 50, the distance between lines 48 and 50 being the height H. Two blades can therefore be made from a single strip of metal width H with very little wasted material as can be seen at the top of the figure where portions 44 and 44' are adjacent. Similarly by carefully relating portions 46 and 46' savings are made. If sweep portion 46 is cut separately and then welded to the leading edge 52 of portion 40 further savings may be made as indicated by the location of sweep portion 46''. After cutting out the flat plate for a blade 6 the blade is bent at lines 54 and 56 at angles of about 30°. If sweep portion 46 is formed from the same integral plate then the sweep portion if bent at about 60°.

Two blades so formed are then welded to the yoke 30 (or 30') so that leading portions 40 and 40' are parallel to the shaft axis 24 (i.e. vertical when the shaft is mounted vertically). The intermediate portions 42, 42' will then each have an inward rake of about 10° to the shaft axis and the trailing portions will each have an inward rake of about 15°. The leading portions may be given a slight inward rake. As seen in the plan view of FIG. 1 the leading portion 40 is angled at about 30° inwardly in the direction of rotation, indicated by arrows 60, from the tangent 62 drawn on the circle 64 of rotation of the leading edge 52 so as to give a slip angle $\alpha$ of 60° at the leading edge. The trailing edge 58 of the blade is so located that it also makes an angle of about 30° in the direction of rotation from the tangent 66 drawn on the circle of rotation 68 of the trailing edge so as to give a slip angle $\beta$ of 60° at the trailing edge.

The sweep portion 46 is directed towards the axis 24 and is thus aligned with the radius 70 so that it extends from the leading edge 52 to an inner circle of rotation 72.

Circle 68 is between 80 and 90% and preferably 85% of diameter D; circle 64 is between 40 and 45% and preferably 42½% of diameter D; and circle 72 is between 15 and 20% of diameter D.

Whilst three main blade portions are preferred for simplicity more than three can be provided.

The blades are intended to be driven by motor 10 so that the trailing edge 58 remains within the speed range of 750/850 ft/min (230/260 m/min), that is at a maximum speed of 22¾ rpm with a 4250 mm diameter vessel using a power input of about 18 kW with 100 poise max viscosity of the product. A product depth M is preferably 0.6 times the diameter D but a product depth may be up to 0.7D. By 'product' is meant the vessel contents. The product density in mash mixers is variable but 10 lb/Gall (1000 kg/m$^3$) is typical.

It will be appreciated that the blades are simply formed and formed with little waste material from plate. Furthermore the planar surfaces also make blade to yoke assembly easy since the jig geometry is simple. The essentially simple geometry of the blades results in a mixer means which is accurately and economically assembled. The mixer itself is thus reliably made and efficient whilst being economical. A further practical advantage results in that the blades are easy to clean as compared with certain known blade configurations.

Furthermore the mixer has been found to provide a high pumping/circulating capacity without shearing because of the blade design. At the same time tests have shown that the power consumption compared to mixer size is lower than other mixers and this is also due to the blade design.

I claim:

1. A fluid mixer for a vessel, said mixer comprising at least two interconnected blades rotatable within said vessel, each blade being mounted opposite the other relative to a rotation axis for said blades, each blade being formed from at least two connected substantially planar portions, the leading edge of the leading planar portion being radially spaced from said rotation axis, the leading planar portion being angled inwardly in the direction of rotation at an angle of about 30° relative to a tangent drawn on a phantom circle of rotation that includes the leading edge of that leading planar portion, and the leading edge of each planar portion being positioned at a lesser radial distance relative to said rotation axis than the trailing edge of each said portion is positioned relative to said rotation axis.

2. A mixer as claimed in claim 1, the trailing planar portion of each blade being angled relative to the vertical towards said rotation axis.

3. A mixer as claimed in claim 2, each blade comprising three planar portions, the leading portion not being angled relative to vertical, the intermediate portion being angled about 10° inwardly relative to vertical, and the trailing portion being angled about 15° inwardly relative to vertical.

4. A mixer as claimed in claim 1, each blade comprising the leading planar portion, an intermediate planar portion and a trailing planar portion.

5. A mixer as claimed in claim 1, each blade comprising a sweep portion connected to the leading planar portion, said sweep portion being generally directed towards said rotation axis from the leading edge of the leading planar portion.

6. A mixer as claimed in claim 1, said mixer comprising a first blade support connected to the leading portion of each blade, and a second blade support connected to the trailing portion of each blade, the first and second supports connected to each blade also being connected one with the other to insure maintenance of blade configuration and position relative to the rotation axis.

7. A mixer as claimed in claim 6, the lower edge of each blade being positioned about 50 mm above the vessel's bottom, and the blade height being about 10% of the diameter of said vessel.

8. A mixer as claimed in claim 1, the circle of rotation of the leading edge of each blade being about 42½% of the diameter of said vessel, the mean circle of rotation of the trailing edge of each blade being about 85% of the diameter of said vessel, and the rotation axis of said blades being about 5% off centre from the center axis of said vessel.

9. A fluid mixer for a vessel, said mixer comprising at least two interconnected blades rotatable within said vessel, each blade being mounted opposite the other relative to a rotation axis for said blades, each blade being formed from three connected substantially planar portions, the leading edge of the leading planar portion for each blade being radially spaced from said rotation axis, the leading edge of each planar portion for each blade being positioned at a lesser radial distance from said rotation axis than the trailing edge of each planar portion is positioned from said rotation axis, the leading portion of each blade not being angled relative to vertical, the intermediate portion of each blade being angled about 10° inwardly relative to vertical, and the trailing portion of each blade being angled about 15° inwardly relative to vertical.

10. A mixer as claimed in claim 9, the leading planar portion of each blade being angled inwardly in the direction of rotation at an angle of about 30° relative to a tangent drawn on a phantom circle of rotation that includes the leading edge of that leading planar portion.

11. A mixer as claimed in claim 10, each blade comprising a sweep portion connected to the leading planar portion, said sweep portion being generally directed from the leading edge of the leading planar portion towards said rotation axis.

12. A mixer as claimed in claim 11, said mixer comprising a first blade support connected to the leading portion of each blade, and a second blade support connected to the trailing portion of each blade, the first and second support connected to each blade also being connected one with the other to insure maintenance of blade configuration and position relative to the rotation axis.

* * * * *